US006658870B1

(12) United States Patent
Jenkins

(10) Patent No.: US 6,658,870 B1
(45) Date of Patent: Dec. 9, 2003

(54) ABSORPTION CHILLER CONTROL LOGIC

(75) Inventor: Neil Jenkins, Collegeville, PA (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/337,595

(22) Filed: Jan. 7, 2003

(51) Int. Cl.[7] ..... F25B 15/06; F25B 15/00
(52) U.S. Cl. ..... 62/141; 62/148
(58) Field of Search ..... 62/141, 148, 476

(56) References Cited

U.S. PATENT DOCUMENTS 4,498,307 A * 2/1985 Hibino et al. ..... 62/148
4,802,100 A * 1/1989 Aasen et al. ..... 700/288
5,130,920 A * 7/1992 Gebo ..... 700/31
5,477,696 A * 12/1995 Takahata et al. ..... 62/148
5,586,447 A * 12/1996 Sibik et al. ..... 62/141
5,848,535 A * 12/1998 Sibik ..... 62/99

* cited by examiner

*Primary Examiner*—William C. Doerrler
(74) *Attorney, Agent, or Firm*—Wall Marjama Bilinski LLP

(57) ABSTRACT

In an absorption chiller system, a control input for the chiller is a heat source controlled by a capacity valve, which is in turn controlled by a PI controller. The controller is controlled by a non-linear control function. During operation, a disturbance in the system is measured. A signal error is defined as a setpoint for the leaving chilled water minus the disturbance. The non-linear control function is represented as $C(s)=K_{P0}(1+b|E|)+K_I/s$, where where $K_{P0}$ is the gain when said signal error is zero, $|E|$ is the absolute value of the signal error, b is an adjustable constant, and $K_I$ is an integral gain.

4 Claims, 3 Drawing Sheets

ABSORPTION CHILLER CONTROL LOGIC

FIELD OF THE INVENTION

This invention relates generally to the field of absorption chillers, and more particularly to a non-linear controller for an absorption chiller.

BACKGROUND OF THE INVENTION

In an absorption chiller, the chilled water temperature in the leaving chilled water line is directly affected by disturbances such as the entering chilled water temperature and the entering cooling water temperature. Because the only control point for the system is a capacity valve which controls the heat to the system, whether from steam or gas flame, and because the system is chemical-based, the machine dynamics of the system are relatively slow. Changes created by the disturbances mentioned above are removed slowly by the existing capacity control.

SUMMARY OF THE INVENTION

Briefly stated, in an absorption chiller system, a control input for the chiller is a heat source controlled by a capacity valve, which is in turn controlled by a PI controller. The controller is controlled by a non-linear control function. During operation, a disturbance in the system is measured. A signal error is defined as a setpoint for the leaving chilled water minus the disturbance. The non-linear control function is represented as $C(s)=K_{P0}(1+b|E|)+K_I/s$, where where $K_{P0}$ is the gain when said signal error is zero, $|E|$ is the absolute value of the signal error, b is an adjustable constant, and $K_I$ is an integral gain.

According to an embodiment of the invention, a method for controlling an absorption chiller system, wherein a control input for said chiller is a heat source controlled by a capacity valve, and wherein said capacity valve is controlled by a PI controller, includes the steps of (a) measuring a disturbance in said system; (b) defining a signal error as a setpoint minus said disturbance; and (c) controlling said capacity valve based on a control function in said PI controller, wherein said control function is represented by $C(s)=K_{P0}(1+b|E|)+K_I/s$, where where $K_{P0}$ is the gain when said signal error is zero, $|E|$ is the absolute value of the signal error, b is an adjustable constant, and $K_I$ is an integral gain.

According to an embodiment of the invention, a control system for an absorption chiller, wherein a control input for said chiller is a heat source controlled by a capacity valve, and wherein said capacity valve is controlled by a PI controller, includes means for measuring a disturbance in said chiller; means for defining a signal error as a setpoint minus said disturbance; and means for controlling said capacity valve based on a control function in said PI controller, wherein said control function is represented by $C(s)=K_{P0}(1+b|E|)+K_I/s$, where where $K_{P0}$ is the gain when said signal error is zero, $|E|$ is the absolute value of the signal error, b is an adjustable constant, and $K_I$ is an integral gain.

DETAILED DESCRIPTION OF THE PREFERRED EMBODIMENT

Figure 1:
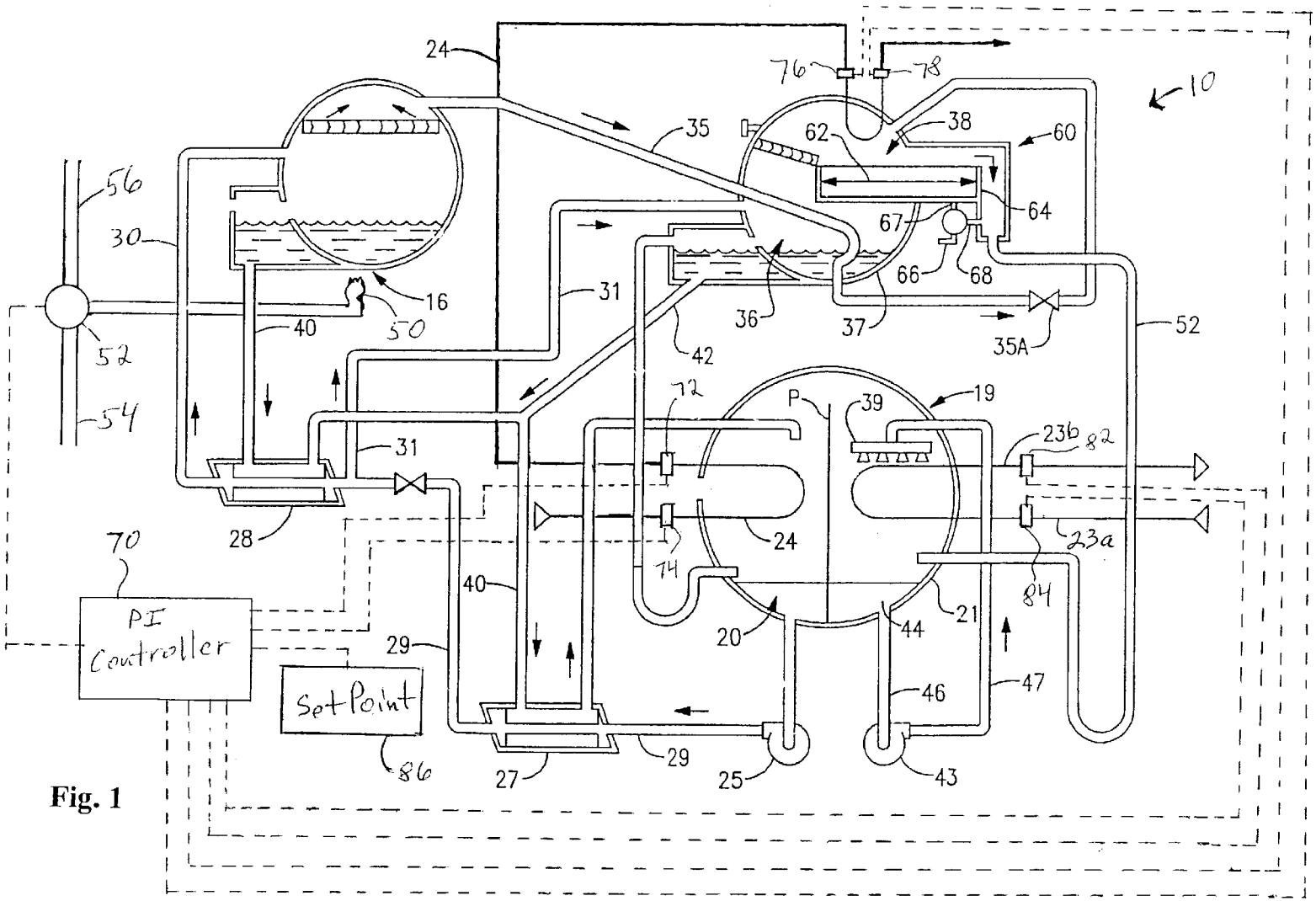
FIG. 1 shows a schematic representation of an absorption chiller system.

Referring to FIG. 1, a schematic representation of an absorption chiller system 10 is shown. Other types of absorption systems may use more or fewer stages, and may use a parallel rather than a series cycle. It will therefore be understood that the absorption system of FIG. 1 is only representative one of the many types of absorption systems that might have been selected to provide a descriptive background for the description of the invention. The control method and apparatus of the invention may be applied to any of these types of heating and cooling systems.

The absorption chiller system 10 is a closed fluidic system that operates in either a cooling mode or in a heating mode, depending upon the concentration of the absorbent in the refrigerant-absorbent solution and on the total quantity of liquid within the system. When system 10 operates in its cooling mode, the solution preferably has a first, relatively high concentration of the absorbent, i.e., is relatively strong or refrigerant poor, while the total quantity of liquid within the system is relatively small. When system 10 operates in its heating mode, the solution preferably has a second, relatively low concentration of the absorbent, i.e., is weak or refrigerant-rich, while the total quantity of liquid within the system is relatively large. In the following brief description of the operation of system 10 in these modes, it is assumed that system 10 employs water as a refrigerant and lithium bromide, which has a high affinity for water, as the absorbent.

System 10 includes an evaporator 19 and an absorber 20 mounted in a side-by-side relationship within a common shell 21. When system 10 is operating in its cooling mode, liquid refrigerant used in the process is vaporized in evaporator 19 where it absorbs heat from a fluid, usually water, that is being chilled. The water being chilled is brought through evaporator 19 by an entering chilled water line 23*a* and a leaving chilled water line 23*b*. Vaporized refrigerant developed in evaporator 19 passes to absorber 20 where it is combined with an absorbent to form a weak solution. Heat developed in the absorption process is taken out of absorber 20 by means of a cooling water line 24.

The weak solution formed in absorber 20 is drawn therefrom by a solution pump 25. This solution is passed in series through a first low temperature solution heat exchanger 27 and a second high temperature solution heat exchanger 28 via a delivery line 29. The solution is brought into heat transfer relationship with relatively strong solution being returned to absorber 20 from the two generators, high temperature generator 16 and low temperature generator 36, employed in the system, thereby raising the temperature of the weak solution as it moves into generators 16, 36.

Upon leaving low temperature solution heat exchanger 27, a portion of the solution is sent to low temperature generator 36 via a low temperature solution line 31. The remaining solution is sent through a high temperature solution heat exchanger 28 and then to high temperature generator 16 via a solution line 30. The solution in high temperature generator 16 is heated by a burner 50 to vaporize the refrigerant, thereby removing it from the solution. Burner 50 is fed from a gas line 54 and an air line 56 via a capacity valve 52. Controlling valve 52 controls the amount of heat delivered to the system. Alternately, the heat delivered to the system comes from a steam line controlled by a steam valve (not shown). The refrigerant vapor produced by high temperature generator 16 passes through a vapor line 35, low temperature generator 36, and a suitable expansion valve 35A to a condenser 38. Additional refrigerant vapor is added to condenser 38 by low temperature generator 36, which is housed in a shell 37 along with condenser 38. In low temperature generator 36, the weak solution entering from line 31 is heated by the vaporized refrigerant passing through vapor line 35 and added to the refrigerant vapor produced by high temperature generator 16. In condenser 38, refrigerant vapor from both generators 16, 36 are placed in heat transfer relationship with the cooling water passing through line 24 and condensed into liquid refrigerant.

Refrigerant condensing in condenser 38 is gravity fed to evaporator 19 via a suitable J-tube 52. The refrigerant collects within an evaporator sump 44. A refrigerant pump 43 is connected to sump 44 of evaporator 19 by a suction line 46 and is arranged to return liquid refrigerant collected in sump 44 back to a spray head 39 via a supply line 47. A portion of the refrigerant vaporizes to cool the water flowing through chilled water line 23. All of the refrigerant sprayed over chilled water line 23 is supplied by refrigerant pump 43 via supply line 47.

Strong absorbent solution flows from the two generators 16, 36 back to absorber 20 to be reused in the absorption cycle. On its return, the strong solution from high temperature generator 16 is passed through high temperature solution heat exchanger 28 and through low temperature solution heat exchanger 27 via solution return line 40. Strong solution leaving low temperature generator 36 is connected into the solution return line by means of a feeder line 42 which enters the return line at the entrance of low temperature solution heat exchanger 27.

Sensors are emplaced in various parts of system 10, including temperature sensors 72, 74, 76, and 78 in cooling water line 24, temperature sensor 82 in the leaving chilled water line 23*b*, and temperature sensor 84 in the entering chilled water line 23*a*. The outputs of these sensors are connected to a controller such as PI controller 70. Controller 70 also includes a connection to capacity valve 52, in addition to receiving input from a thermostat, shown here as a set point 86.

The chilled water temperature in the leaving chilled water line 23*b* is directly affected by disturbances such as the entering chilled water temperature (sensor 84) in water line 23*a* and the entering cooling water temperature (sensor 74) in cooling water line 24. Because the only control point for the system is capacity valve 52, and because the system is chemical-based, the machine dynamics of the system are relatively slow. Changes created by the disturbances mentioned above are removed slowly by the existing capacity control.

Currently, the capacity valve 52 control is based on proportional-integral (PI) control logic based in PI controller 70. The output signal to capacity valve 52, which controls burner 50, is a function of the setpoint error, that is, the chilled water leaving setpoint value from setpoint 86 minus the measured chilled water leaving temperature from sensor 82. As is known in the art, the proportional part of the PI control multiplies the error by a constant, the proportional gain $K_P$, while the integral part consists of the error integrated over time and multiplied by an integral gain $K_I$. The transfer function of a basic PID controller is $Gc(s)=K_P+K_Ds+K_I/s$, but when the controller is used only as a PI controller, the derivative gain is not used and the $K_Ds$ term drops out. Thus, the basic transfer function of the PI controller is represented as $Gc(s)=K_P+K_I/s$.

Figure 2:
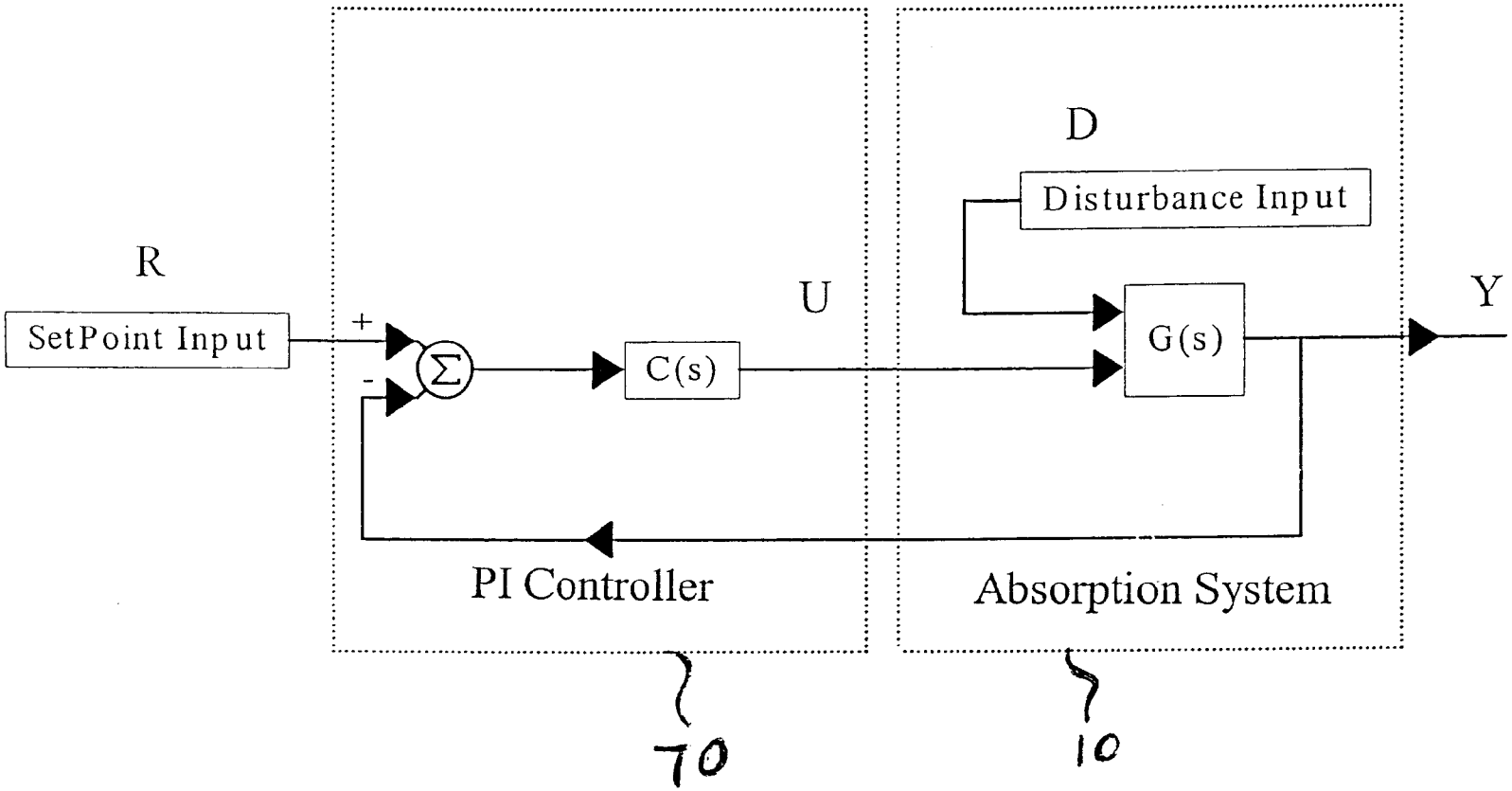
FIG. 2 shows a control schematic is shown for the absorption chiller system of FIG. 1.

Referring to FIG. 2, a control schematic is shown for absorption chiller system 10. The existing capacity control law is shown as C(s), while G(s) is the transfer function for absorption system 10. The idea behind the nonlinear adaptive gain of the present invention is that a nonlinear process is best controlled by nonlinear controllers. Essentially, the proportional gain $K_P$ in the controller transfer function is made variable by expressing it as a function of the signal error, that is, the setpoint minus the measurement, as $$K_P=K_{P0}(1+b|E|)$$

where $K_{P0}$ is the gain when the error is zero, |E| is the absolute value of the error, and b is an adjustable constant. Since the proportional gain $K_P$ is already multiplied by the error, this expression results in the output signal being proportional to the error squared. Thus, $C(s)=K_P+K_I/s=K_{P0}(1+b|E|)+K_I/s$.

An advantage of using this expression is that a low value for $K_{P0}$ can be used so that the system is stable around the setpoint, resulting in greatly reduced overshoot and undershoot of the chilled water setpoint.

When a large disturbance enters the system, the magnitude of the error results in a large gain which serves to move the burner control rapidly to deal with the transient disturbance. Using this expression also has the advantage of reducing the effect of signal noise around the setpoint, thereby preventing continuous oscillation of the leaving chilled water temperature. This control algorithm requires minimal modification to the existing control routine, but it offers drastic improvement to the current proportional-integral control of the burner.

Figure 3:
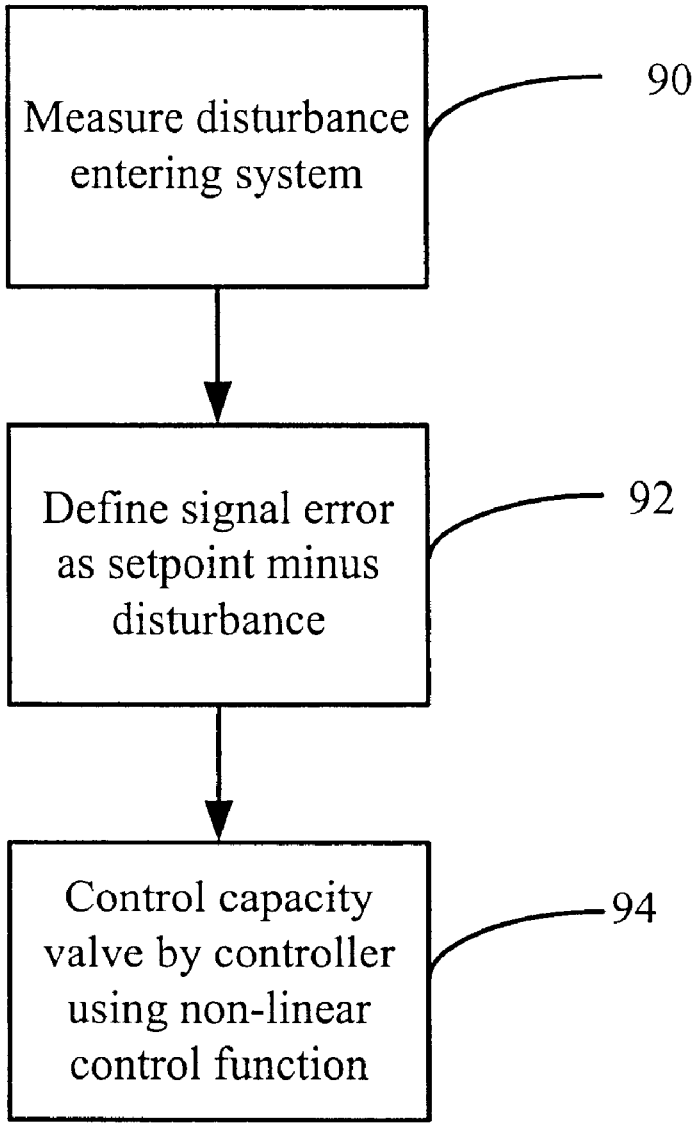
FIG. 3 shows the steps in a control method according to an embodiment of the invention.

Referring to FIG. 3, the steps of the method of the present invention are shown. In step 90, the disturbance entering the system is measured. The disturbance is preferably the chilled water temperature, and either the entering chilled water temperature or the leaving chilled water temperature may be used. In step 92, the signal error is defined as the setpoint for the leaving chilled water temperature minus the disturbance. Then in step 94, the capacity control valve for absorption chiller 10 is controlled by PI controller 70 using the nonlinear control function described above.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method for controlling an absorption chiller system, wherein a control input for said chiller is a heat source controlled by a capacity valve, and wherein said capacity valve is controlled by a PI controller, comprising the steps of:

measuring a disturbance in said system;

defining a signal error as a setpoint minus said disturbance; and controlling said capacity valve based on a control function in said PI controller, wherein said control function is represented by $C(s)=K_{P0}(1+b|E|)+K_I/s$, where where $K_{P0}$ is the gain when said signal error is zero, |E| is the absolute value of the signal error, b is an adjustable constant, and $K_I$ is an integral gain.

2. A method according to claim 1, wherein said setpoint determines a desired leaving chilled water temperature of said chiller and said disturbance is an entering chilled water temperature of said chiller.

3. A control system for an absorption chiller, wherein a control input for said chiller is a heat source controlled by a capacity valve, and wherein said capacity valve is controlled by a PI controller, comprising:

means for measuring a disturbance in said chiller;

means for defining a signal error as a setpoint minus said disturbance; and means for controlling said capacity valve based on a control function in said PI controller, wherein said control function is represented by $C(s)=K_{P0}(1+b|E|)+K_I/s$, where where $K_{P0}$ is the gain when said signal error is zero, $|E|$ is the absolute value of the signal error, b is an adjustable constant, and $K_I$ is an integral gain.

4. A control system according to claim 3, wherein said setpoint determines a desired leaving chilled water temperature of said chiller and said disturbance is an entering chilled water temperature of said chiller.

* * * * *